United States Patent [19]

Teno

[11] 4,282,919

[45] Aug. 11, 1981

[54] INTERIOR STORM WINDOW

[76] Inventor: Francis D. Teno, 17696 Toepfer, East Detroit, Mich. 48021

[21] Appl. No.: 138,662

[22] Filed: Apr. 9, 1980

[51] Int. Cl.[3] ..... E06B 9/08

[52] U.S. Cl. ..... 160/23 R; 160/269; 160/271; 160/290 R

[58] Field of Search ..... 160/268–273, 160/23 R, 290, 380

[56] References Cited

U.S. PATENT DOCUMENTS

| | | | |
|---|---|---|---|
| D. 238,667 | 2/1976 | Bero . | |
| 446,242 | 2/1891 | Wilson . | |
| 1,127,571 | 2/1915 | Woolery | 160/270 |
| 1,395,475 | 11/1921 | Bried . | |
| 1,836,387 | 12/1931 | Nye . | |
| 2,009,917 | 7/1935 | Flanagan . | |
| 2,350,200 | 5/1944 | Starr | 160/269 |
| 2,509,398 | 5/1950 | Peremi et al. | 160/23 R |
| 2,548,041 | 4/1951 | Morse | 160/269 |
| 2,856,995 | 10/1958 | Roth . | |
| 3,729,045 | 4/1973 | MacDonald | 160/380 |
| 3,939,620 | 2/1976 | Bere . | |
| 4,079,772 | 3/1978 | Kleinhammer et al. . | |
| 4,184,297 | 1/1980 | Casamayor . | |

*Primary Examiner*—Philip C. Kannan

*Attorney, Agent, or Firm*—Basile, Weintraub & Hanlon

[57] ABSTRACT

A storm window for sealing the entire interior surface of an existing window in a building. The storm window includes a flexible sheet which is extendably and retractably deployed from a shade roller mounted at the top of the existing window. A hinged cover member surrounds the roller and engages the top of the sheet to form an air tight seal therebetween. Hinged clamping members are mounted along the sides of the existing window and clampingly engage the side edges of the sheet when the sheet is in the full extended position to form an air tight seal. A drawbar is secured to the bottom edge of the sheet and has a sealing strip mounted to the bottom surface thereof to sealingly engage the window sill when the sheet is in the full extended position. The drawbar is biased into the sealing position by a boss which extends from the clamping member and engages a flange on the drawbar.

7 Claims, 4 Drawing Figures

INTERIOR STORM WINDOW

BACKGROUND OF THE INVENTION

1. Field Of The Invention

This invention relates, in general, to windows and, more specifically, to storm windows for sealing existing windows.

2. Description Of The Prior Art

It is known that a major portion of the heat loss from the interior of a building or a residential home occurs around windows. Many efforts have been made to seal the gaps or cracks existing around windows. These efforts include the insulation of storm windows on the exterior of the building. It is also known to install a removable, transparent panel on the interior of the building to completely seal around an existing window. Such devices, as shown in U.S. Pat. Nos: 2,009,917 and 4,079,772, include a flexible panel mounted on a spring roller which is disposed above the window and can be raised or lowered as desired. These devices also include means for sealing the edges of the panel to the window frame, such as the magnetic strips shown in U.S. Pat. No. 4,079,772 or the sealing strips disposed in channels mounted on the window frame in which the edges of the panel slide. Although such devices minimize heat loss to a certain extent, problems relating to obtaining a complete seal around the side edges of the flexible sheet still exist.

It is also known to removably install a rigid panel on the interior side of an existing window as shown in U.S. Pat. Nos: 3,939,620; 4,184,297 and Design Patent No. 238,667. These rigid panels are held in hinged strips secured to the window frame. Although the rigid panels are more easily sealed to the window frame, it is burdensome to store the bulky panel when not in use as well as to install and remove the panel from the hinged side members.

Thus, it would be desirable to provide a storm window adapted to be installed on the interior side of an existing window which overcomes the problems of prior art storm windows. It would also be desirable to provide an interior storm window which completely seals an existing window. Finally, it would be desirable to provide an interior storm window which is easily installed and/or removed from an existing window.

SUMMARY OF THE INVENTION

In the present invention, a storm window for sealing the entire interior surface of an existing building or residential home window is disclosed. The interior storm window comprises a flexible sheet which is extensably and retractably disposed on a supporting means, such as a conventional shade roller. Means, surrounding the top portion of the flexible sheet and the shade roller, are provided for releasably and sealingly covering the supporting means and the top portion of the flexible sheet to form an air tight seal therebetween. The interior storm window further includes hinged clamping means disposed along the sides of the existing window for releasably clamping the side edges of the flexible sheet, when the sheet is in the extended position, to form an air tight seal therebetween. Finally, means for locking the bottom portion of the sheet in an air tight seal relationship with the window seal is provided.

The storm window of this invention provides a significant reduction in the heat loss normally experienced around windows of a building or residential home. The storm window of this invention is installed on the interior side of an existing window and includes a flexible sheet which can be removably sealed around the entire inner surface of an existing window. The flexible sheet is extendable and retractable so as to be easily stored out of the way when not in use.

According to this invention, means are provided for releasably forming an air tight seal around all four edges of the sheet when the sheet is disposed in the fully extended position. The hinged cover means mounted at the top of the window uniquely provides an air tight seal around the top portion of the flexible sheet. Hinged clamping members disposed along both sides of the window clampingly engage the side edges of the sheet between the interlocking portions thereof to provide a secure air tight seal along the entire length of the sides of the flexible sheet. Finally, unique locking means are provided on the clamping means and on a drawbar secured to the bottom portion of the sheet to sealingly lock the drawbar and the bottom portion of the sheet to the existing window sill.

Thus, the storm window of this invention provides a complete air tight seal around all four sides of the flexible sheet. At the same time, the sheet can be easily extended or retracted as desired.

BRIEF DESCRIPTION OF THE DRAWING

The various features, advantages and other uses of this invention will become more apparent by referring to the following detailed description and the drawing in which.

DESCRIPTION OF THE PREFERRED EMBODIMENT

Figure 1:
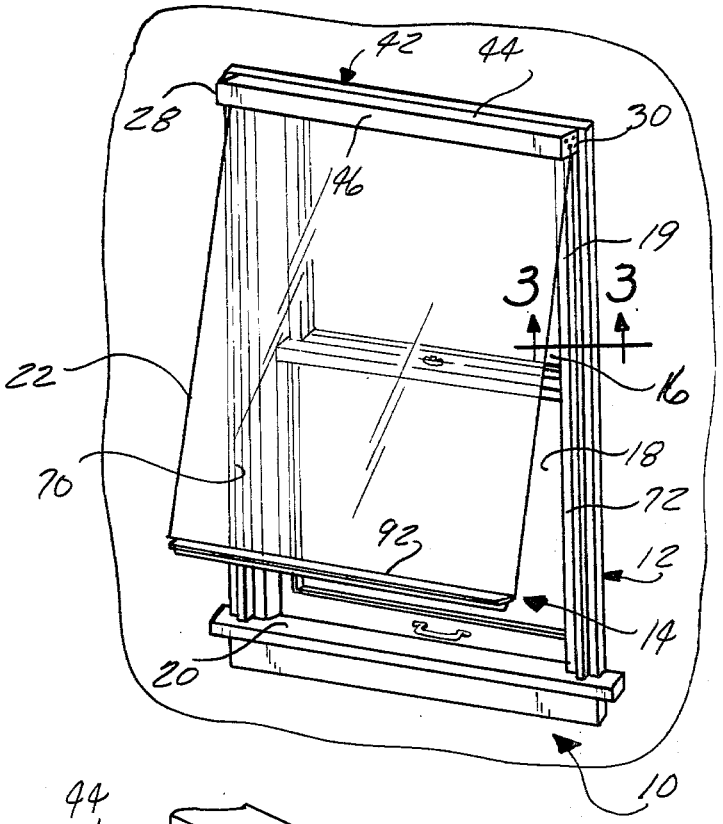
FIG. 1 is a perspective view of an interior storm window constructed according to the teachings of this invention.

Throughout the following description and drawing, identical reference numbers are used to refer to the same component shown in multiple figures of the drawing.

Referring now to the drawing, and to FIG. 1 in particular, there is illustrated an interior storm window 10 constructed according to the teachings of this invention. The interior storm window 10 is adapted to seal the entire inner surface of an existing building or residential home window, shown generally at reference number 12. The window 12, which may be of any constructional construction, typically comprises a transparent panel or glass pane 14. The glass pane 14 may be of an integral construction or, as illustrated in FIG. 1, may be formed of a first stationary portion 16 and a lower movable portion 18. Both portions 16 and 18 are mounted in a conventional frame assembly 19. The frame assembly 19 surrounds the glass panes 16 and 18 and supports the panes in position within a wall of the building. A conventional window sill 20 may also be disposed adjacent the bottom of the window 12.

The interior storm window 10 includes a flexible sheet 22 formed of any suitable material. The flexible sheet 22 may be formed of a transparent material, such as a plastic, as well as any other suitable translucent or opaque msterials. Preferably, the flexible sheet 22 provides thermal insulation characteristics so as to prevent heat loss through the window 12.

Figure 2:
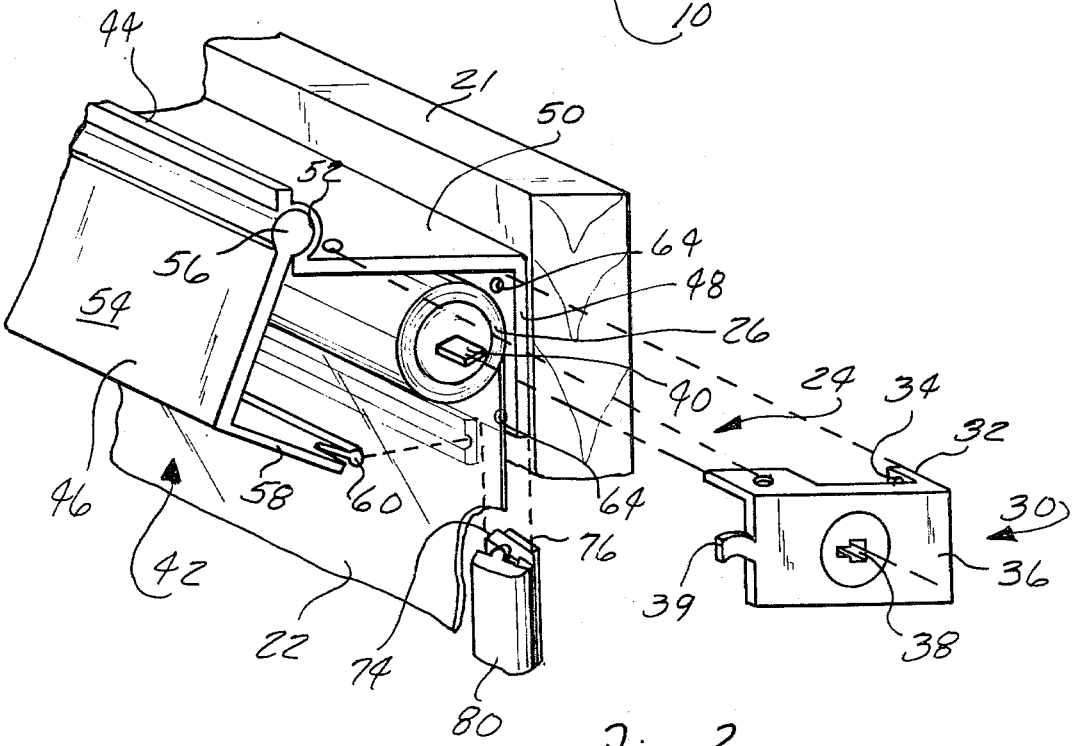
FIG. 2 is an exploded, partial perspective view of the top portion of the interior storm window shown in FIG. 1.

The interior storm window 10 further includes means, shown generally at reference number 24 in FIG. 2, for rotatably supporting the flexible sheet 22. Supporting means 24 comprises a conventional shade roller 26 which is rotatably mounted in a pair of spaced end brackets 28 and 30. The flexible sheet 22 is wrapped around the shade roller 26 in a conventionally known manner so as to be extendable or retractable therefrom as desired. Each of the end brackets 28 and 30, such as end bracket 30, illustrated in FIG. 2, generally comprise a L-shaped metal stamping having a first leg portion 32 containing apertures 34 which are utilized to secure the end bracket 30 to the planar surface adjacent the top portion of the window 14. The end bracket 30 further includes a second leg portion 36 which extends substantially perpendicularly from the first leg portion 32 and includes a centrally disposed aperture 38 which removably receives a prong 40 extending outwardly from the end of the shade roller 26. A locking tab 39 extends outwardly from the second leg 36. The locking tab 39 is adapted to be bent so as to engage the covering means, described hereafter, to bias the covering means into the closed, sealing position.

The interior storm window 10 of this invention further includes means, shown generally in reference number 42, surrounding the supporting means 24 for releasably and sealingly covering the supporting means 24. The covering means 42 comprises first and second members 44 and 46 which are pivotally connected together. The first member 44 has an L-shaped configuration with a first leg 48 which is adapted to be secured to the planar surface adjacent the window 12 by conventional fastening means, not shown. It is also desirable that a layer strip of a suitable weatherstrip material, such as foam rubber, be disposed between the first leg 48 and the window frame 19. The first member 44 further includes a second leg or flange 50 extending substantially perpendicularly from the first leg 48. The outermost end of the second flange 50 of the first member 44 terminates in a longitudinally extending groove 52 which is adapted to pivotally receive the second member 46, as described in greater detail below.

The second member 46 of the covering means 42 similarly has a substantially L-shaped configuration with a first leg portion 54 having an enlarged substantially circular boss portion 56 disposed at the end thereof. The boss portion 56 is pivotally secured within the channel 52 in the first member 44 so as to define a substantially hinged connection between the first and second members 44 and 46, respectively, of the covering means 42.

The second member 46 further includes a second leg 58 extending substantially perpendicular from the first leg 54. The second leg 58 also terminates in a rounded boss portion 60. The boss portion 60 on the second member 46 is adapted to releasably interlock with a corresponding longitudinally extending groove 62 formed in the bottom portion of the first leg 48 of the first member 44. Both of the first and second members 44 and 46 are formed of a flexible material, such as a suitable plastic, to provide a secure but releasable fit between the boss 60 and the groove 62. In this manner, the flexible sheet 22 may be extended from the roller 26 and the second member 46 of the covering means 42 urged into interlocking relationship with the first member 44 thereby clamping the sheet 22 between the boss portion 60 of the second member 46 and the groove 62 of the first member 44 so as to provide an air tight seal along the top portion of the flexible sheet 22.

It should also be noted that the first member 44 of the cover means 42 includes apertures 64 formed at opposed ends thereof. The apertures 64 are adapted to correspond to the apertures 34 in the end brackets 28 and 30 such that conventional fasteners, not shown, may be disposed therethrough so as to securely mount the end brackets 28 and 30 to the first member 44 of the covering means and to the wood frame 19 surrounding the window 12.

The interior storm window 10 of this invention also includes clamping means 70 and 72, shown in FIG. 1, which are disposed along the sides of the window 12 adjacent the edges of the flexible sheet 22. Since the clamping means 70 and 72 are identically constructed, only the detailed construction of one of the clamping means, such as clamping means 72, will be described hereafter.

Figure 3:
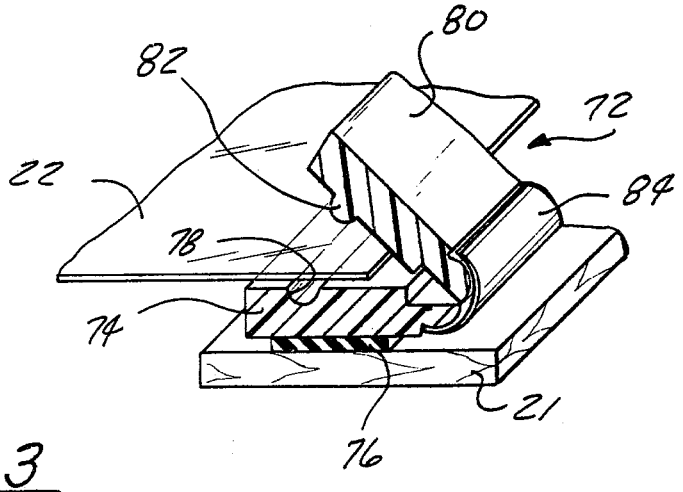
FIG. 3 is an exploded, partial perspective view of the side edge clamping means illustrated in FIG. 1.

As shown in FIG. 3, the clamping means 72 comprises a substantially vertically extending assembly disposed along the side edges of the window 12. The clamping means 72 comprises a first member 74 which is adapted to be secured to the planar surface 21 adjacent the sides of the window 12 by any conventional means, such as by fasteners, not shown, which extend through the first member 74 into the planar surface 21 surrounding the sides of the window 12. A weatherstrip 76 is disposed between the back surface of the first member 74 and the planar surfaces 21 adjacent the sides of the window 12 to form an air tight seal therebetween. Other types of fastening means, such as providing the weatherstrip 76 with adhesive material on both sides thereof, may also be used to mount the clamping means 70 and 72 in the desired position.

As illustrated in FIG. 3, the first member 74 of the clamping means 72 includes a groove or channel 78 which is disposed substantially centrally of the first member 74 and extends the entire length thereof.

The clamping means 72 further comprises a second member 80 which is of the same general configuration as the first member 74. However, the second member 80 includes a projection or boss 82 extending therefrom which is complimentarily formed with the groove 78. The boss 82 is adapted to releasably and interlockingly engage the groove 78 formed in the first member 74 so as to provide a friction fit therebetween and thereby maintain the first and second members 74 and 80 of the clamping means 72 in secure engagement. Both of the first and second members 74 and 80 are preferably formed of a flexible plastic to provide a secure but releasable fit between the boss 82 and groove 78. When the first and second members 74 and 80 of the clamping means 72 are disposed in interlocking relationship, the projection 82 securely traps the side edges of the flexible sheet 22 within the groove 78 formed in the first member 74 to provide an air tight seal along the side edges of the sheet 22.

Means, shown generally at reference number 84, are provided for forming a hinged relationship between the first and second members 74 and 80 of the clamping means 72. In the preferred embodiment, the hinged means 84 comprises an adhesive strip which is secured along one edge of both first and second members 74 and 80 such that the second member 80 may be pivotally moved with respect to the stationarily affixed first member 74. It is also contemplated that the strip 84 may be integrally formed with the first and second members 74 and 80. In either case, the flexible sheet 22 may be releasably secured between the first and second members 74 and 80 so as to provide an air tight seal along the side edges thereof when the sheet 22 is disposed in the extended position and, at the same time, the second member 80 may be easily disengaged from the first member 74 to enable the flexible sheet 22 to be removed from the clamping means 72 and retracted when its use is no longer desired.

Figure 4:
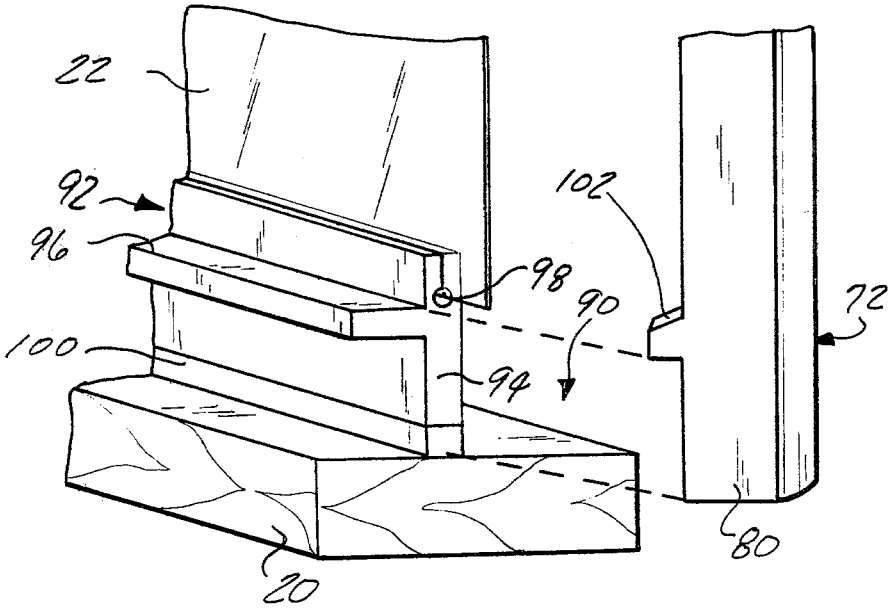
FIG. 4 is an exploded, partial perspective view of the bottom portion of the interior storm window illustrated in FIG. 1.

Referring now to FIG. 4, there is shown means, shown generally at reference number 90, for sealingly locking the bottommost edge of the sheet 22 to the planar surface, such as the window sill 20, adjacent the bottom portion of the existing window 12. The locking means 90 comprises a drawbar 92 which is constructed in the form of a substantially T-shaped member having an upwardly extending portion 94 and an outwardly extending flange 96. The upwardly extending portion 94 of the drawbar 92 has an integrally formed slot 98 formed therein which is adapted to receive the bottommost edge of the flexible sheet 22. The flexible sheet 22 is disposed within the groove 98 and secured thereto by any conventional means, such as fasteners or an adhesive. In this manner, the drawbar 92 enables the user to raise or lower the flexible sheet 22 as desired.

A sealing strip 100 is secured to the bottommost edge of the upwardly extending portion 94 of the drawbar 92. The sealing strip 100 may be formed of any conventional sealing material, such as foam rubber, so as to provide an air tight seal between the drawbar 92 and the window sill 20, when the flexible sheet 22 is disposed in the fully extended position.

The locking means 90 further includes means for biasing the drawbar 92 into sealing relationship with the sill 20 of the window 12. The biasing means constitutes an outwardly extending projection or boss 102 which is disposed on at least the pivotal second member 80 of the clamping means 72. The boss 102 engages the top surface of the flange 96 or the drawbar 92 when the second member 80 of the clamping means 72 is urged into interlocking relationship with the first member 74 of the clamping means 72. In this manner, the drawbar 92 is biased into sealing relationship with the window sill 20 so as to provide an air tight seal along the bottom portion of the flexible sheet 22.

In summary, there has been disclosed herein an interior storm window which is adapted to seal the entire interior surface of an existing building or residential home window. The interior storm window of this invention provides a unique air tight seal along all four sides of the flexible sheet. At the same time, the flexible sheet is easily extendable and retractable as desired.

What is claimed is:

1. An auxiliary window for sealing an existing window opening comprising:

a flexible sheet;

means for extendably and retractably supporting said sheet such that the sheet is extendable over the entire surface area of said existing window opening;

means, carrying and releasably surrounding said supporting means, for sealingly covering said supporting means, said covering means including:

a first member adapted to be mounted to the vertical planar surface surrounding said window opening; and a second member pivotally connected to said first member at a first end thereof;

said first and second members being releasably interlockable along the entire length of a second edge so as to surround the supporting means and trap the top portion of the sheet therebetween to provide an air tight seal therealong;

said supporting means including:

a spring roller adapted to carry said flexible sheet; and first and second spaced end brackets mounted to said first member of said covering means and adapted to rotatably support said spring roller therebetween;

means for releasably clamping the side edges of said sheet when said sheet is extended over said existing window opening, said clamping means being adapted to be secured to the vertical planar surfaces surrounding said existing window opening; and means for sealingly locking the bottommost edge of said sheet to the planar surface adjacent the bottom of said existing window opening.

2. The auxiliary window of claim 1 wherein the clamping means comprises:

a first member adapted to be secured to the vertical planar surface surrounding the side of the existing window opening, said first member having a channel extending along the length thereof; and a second member pivotally connected to the first member at a first edge thereof, said second member having a complimentary formed projection extending outwardly along the length thereof and adapted to releasably and interlockably engage said channel in said first member, said channel and said projection cooperating to sealingly clamp the side edges of the sheet therebetween when said sheet is extended.

3. The auxiliary window of claim 1 further including:

a bendable locking tab extending outward from each of the end brackets;

said tabs adapted to be bent around the second member of the covering means to bias said second member into locking engagement with the first member of said covering means.

4. The auxiliary window of claim 1 wherein the first member has a channel formed therein which extends along the entire length thereof; and the second member having a complimentary formed projection extending outwardly therefrom which is releasably interlockable within said channel in said first member so as to clamp the flexible sheet therebetween and form an air tight seal.

5. The auxiliary window of claim 1 wherein the locking means includes a drawbar secured to the bottom edge of the sheet and a sealing strip affixed to the bottom surface of said drawbar and adapted to form an air tight seal with the planar surface adjacent the bottom of the existing window opening;

said drawbar having a length less than the width of said sheet such that the side edges of said sheet extend outward beyond the ends of said drawbar to be sealingly engaged by the clamping means.

6. The auxiliary window of claim 5 wherein the locking means further comprises:

a projection extending outwardly from the bottom portion of the clamping means; and a longitudinally extending flange on the drawbar;

said flange being removably disposable beneath said projection when the flexible sheet is fully extended such that said projection biases said drawbar into sealing engagement with the planar surface adjacent the bottom of the existing opening.

7. An auxiliary window for sealing an existing window opening comprising:

a spring roller;

first and second spaced mounting brackets for rotatably supporting said spring roller;

a flexible sheet adapted to be wrapped around said roller and be extendable and retractable therefrom;

a cover adapted to be mounted to the top portion of the vertical planar surface surrounding said existing window opening;

said cover including first and second members, said first member adapted to be mounted to said vertical planar surface surrounding said existing window opening and having said mounting brackets mounted thereto, said second member being pivotally connected to said first member, said first member including a channel and said second member including a complimentary formed projection, said projection and said channel being releasably interlockable along the entire length thereof and cooperating to sealingly clamp the top portion of said flexible sheet therebetween;

clamping members disposed adjacent the side edges of said existing window, said clamping members comprising first and second longitudinally extending strips, said first strip being adapted to be secured to the vertical side edges of said existing window opening, said second strip being pivotally connected to said first strip, said first strip having a channel extending the length thereof, said second strip having a complimentary formed projection extending outwardly along the length thereof, said channel and said projection being releasably interlockable and co-operating to sealingly clamp the side edges of said sheet therebetween;

a drawbar secured to the bottom edge of said flexible sheet, said drawbar having a length shorter than the width of said sheet such that the side edges of said sheet extend outward beyond the ends of said drawbar to be engaged by the clamping members;

a sealing strip disposed on the bottom surface of said drawbar to form an air tight seal with the bottom planar surface of said existing window when said sheet is disposed in the extended position; and an interlocking boss projecting outward from said second member of said clamping means, said boss engaging a flange on said drawbar to bias said drawbar to sealing engagement with the bottom planar surface adjacent said existing window opening.

* * * * *